US005672015A

United States Patent [19]

Lyerly et al.

[11] Patent Number: 5,672,015

[45] Date of Patent: Sep. 30, 1997

[54] APPARATUS AND METHOD FOR PRINTING

[75] Inventors: Jeffrey B. Lyerly, Harrisburg; Frederick C. Miller; Carl W. Robinson, both of Charlotte, all of N.C.

[73] Assignee: International Business Machines Corporation, Armonk, N.Y.

[21] Appl. No.: 226,145

[22] Filed: Apr. 11, 1994

[51] Int. Cl.[6] ..... B41J 11/20

[52] U.S. Cl. ..... 400/58; 400/247

[58] Field of Search ..... 400/56, 58, 248, 400/55, 57, 59, 247; 347/8

[56] References Cited

U.S. PATENT DOCUMENTS

| | | | |
|---|---|---|---|
| 3,750,792 | 8/1973 | Liles | 197/1 R |
| 4,010,834 | 3/1977 | Linder | 197/1 R |
| 4,090,600 | 5/1978 | Biedermann | 400/213 |
| 4,143,977 | 3/1979 | Kurihara et al. | 400/58 |
| 4,227,819 | 10/1980 | Manriquez | 400/55 |
| 4,420,269 | 12/1983 | Ackermann et al. | 400/56 |
| 4,571,102 | 2/1986 | Ono et al. | 400/248 |
| 4,632,577 | 12/1986 | Brull et al. | 400/56 |
| 4,773,779 | 9/1988 | Wyne | 400/247 |
| 4,893,949 | 1/1990 | Limberger et al. | 400/56 |
| 4,957,382 | 9/1990 | Delaney et al. | 400/58 |
| 4,960,337 | 10/1990 | Kato et al. | 400/248 |
| 5,000,591 | 3/1991 | Burgess | 400/58 |
| 5,090,825 | 2/1992 | Merriman, Jr. et al. | 400/58 |
| 5,172,987 | 12/1992 | Stellmach et al. | 400/56 |
| 5,181,789 | 1/1993 | Blair | 400/248 |

FOREIGN PATENT DOCUMENTS

| | | |
|---|---|---|
| 3339729 | 8/1984 | Denmark . |
| 5878776 | 5/1983 | Japan . |

OTHER PUBLICATIONS

IBM Technical Disclosure Bulletin, "Floating Platen For Printing on Irregular Contours", F. R. Humphreys, vol. 15, No. 1, p. 179, Jun. 1972.

IBM Technical Disclosure Bulletin, "Passbook Printing Improvement", vol. 29, pp. 2724–2725, Nov. 1986.

*Primary Examiner*—John S. Hilten

*Attorney, Agent, or Firm*—A. P. Tennent

[57] ABSTRACT

An improved method and apparatus in a printing device having a printhead displaceable along a record carrier. The record carrier is supported beneath the printhead by a platen. The improved apparatus includes a mechanism for spacing the printing distance between the printhead and the record carrier. The spacing mechanism is positioned to bear upon the record carrier in advance of the printhead. A mechanism urges the platen away from the printhead and the spacing mechanism so as to permit a ribbon mechanism to be inserted between the printhead and the platen.

1 Claim, 10 Drawing Sheets

APPARATUS AND METHOD FOR PRINTING

BACKGROUND OF THE INVENTION

1. Field of the Invention

The present invention relates to an apparatus and method for printing. More particularly, the present invention relates to a cutform or passbook printer.

2. Description of Related Art

The present invention relates particularly to cutform and passbook printers (hereinafter "passbook" printers). "Cutforms" refer to documents such as receipts, deposit slips, withdrawal slips, checks, and validation forms that can be either single sheet or multi-part documents. "Passbooks" refer to covered, multi-page transaction registers that fold either vertically or horizontally. "Record carrier" refers to any type of medium to be printed upon, including cutforms and passbooks.

Passbook printers are frequently used in the financial services industry (e.g., banking industry). An example of a such a printer is the IBM 4722 Document Printer, which is described in the "IBM 4700 Financial I/O Operating Guide" (SC31-3763-1). The printers ordinarily attach to a computer system such as an IBM® Personal System/2® (PS/2®) computer, a mini-computer, or a mainframe computer.

The printing mechanism for passbook printers is often impact printing, as in dot matrix printers, although electrostatic passbook printers have also been developed.

Passbook printers must be able to accept a variety of record carriers in a variety of shapes and thicknesses. This, in turn, presents a number of printing-related problems. The prior art contains a number of different approaches for maintaining constant printhead-to-record carrier gap, such as floating print-head, floating platen, and split platens. If the gap varies, quality of printing is inconsistent, making the printing hard to read.

In general, existing printers suffer from a number of disadvantages sought to be addressed by the present invention. For example, some printers leave roller markings on multi-part documents such as cutforms and passbooks. Other printers employ expensive, unreliable and cumbersome bails or paper guides which rotate during document feeding or printing. Still other printers include a roller which rolls over wet ink from freshly printed characters and therefore smears such ink onto the print medium.

SUMMARY OF THE INVENTION

The present invention overcomes the disadvantages and limitations of the related art by providing an improved method and apparatus for printing having a printhead displaceable along a record carrier. The record carrier is supported beneath the printhead by a platen.

The improved apparatus includes a mechanism for automatically spacing the printing distance between the printhead and the record carrier. The spacing mechanism is positioned to bear upon the record carrier in advance of the printhead, relative to the direction of an advancing record carrier, such that the spacing mechanism makes contact with the record carrier prior to printing on the record carrier. A mechanism urges the platen away from the printhead and the spacing mechanism so as to permit a ribbon mechanism to be inserted between the printhead and the platen.

The improved method includes spacing the printing distance between said printhead and the record carrier with a spacing mechansim. The spacing mechanism is positioned to bear upon the record carrier in advance of the printhead, relative to the direction of an advancing record carrier, such that the spacing mechanism makes contact with the record carrier prior to printing on the record carrier. The platen is urged away from the printhead and the spacing means so as to permit a ribbon to be inserted between the printhead and the platen.

An advantage of the invention is to provide an apparatus and method for avoiding roller marking on multi-part documents such as cutforms and passbooks by advantageous placement of spacing means, such as a print gap roller.

Another advantage of the invention is to provide an apparatus and method for eliminating the need for bails wherein a roller would traverse thereover, or paper guides which rotate during document feeding or printing.

Another advantage of the invention is to provide an apparatus and method wherein a roller or bail does not roll over or touch wet ink from freshly printed characters and does not therefore smear such ink onto the print medium.

The foregoing and other objects and advantages of the present invention will be apparent to those skilled in the art of printers in view of the accompanying drawings, description of the invention, and appended claims.

DESCRIPTION OF THE PREFERRED EMBODIMENT

Figure 1:
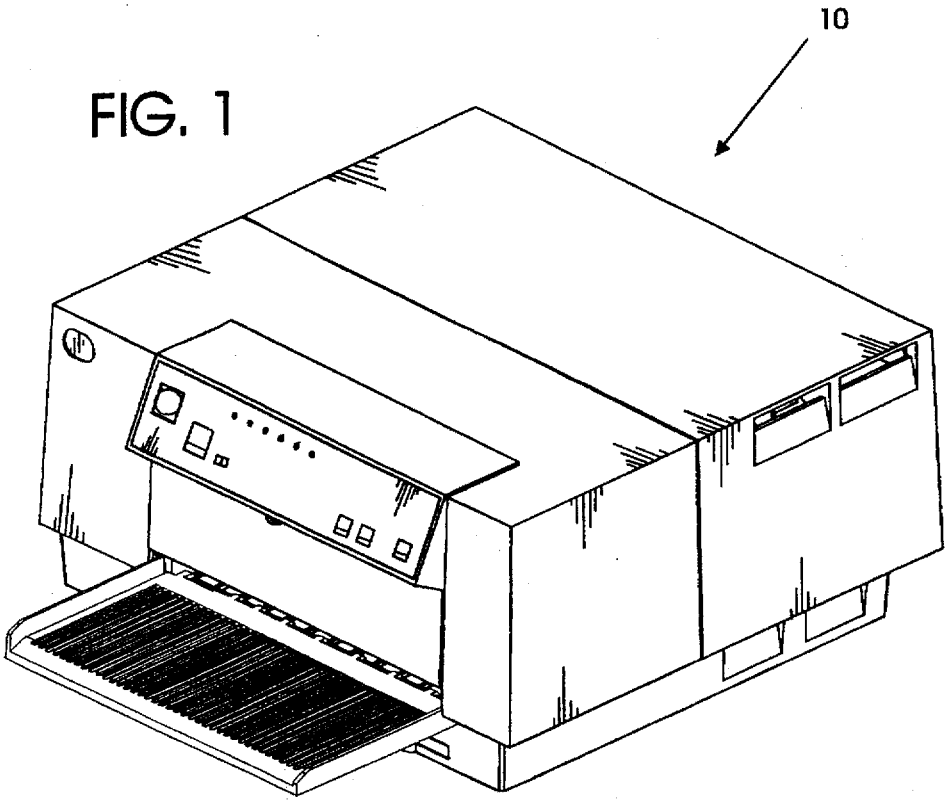
FIG. 1 is a perspective view depicting a printer in which the invented apparatus and method might be employed.
Figure 10:
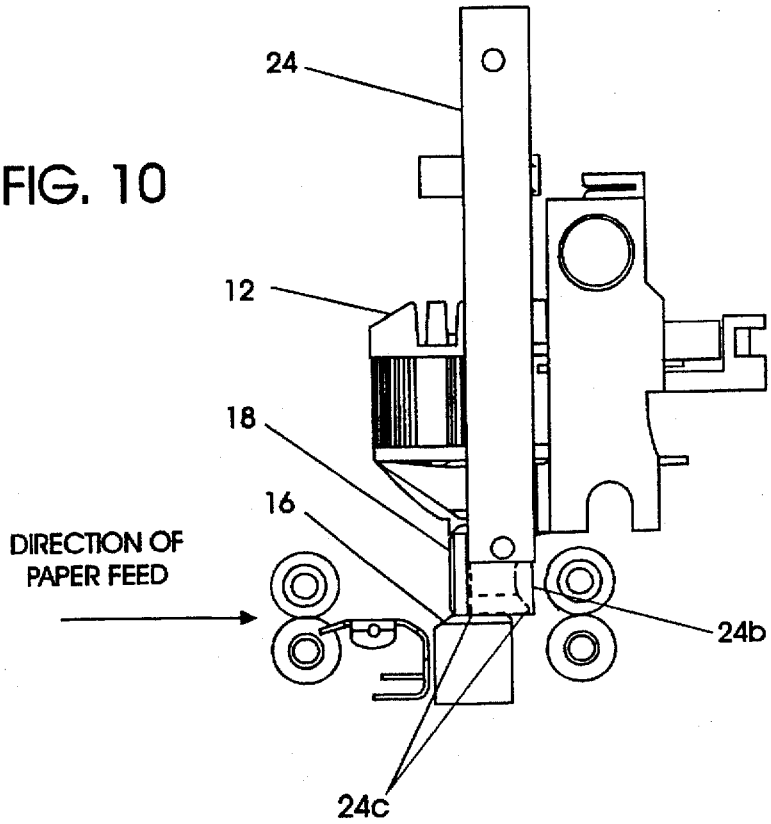
FIG. 10 is a side elevational view of FIG. 9.
Figure 2:
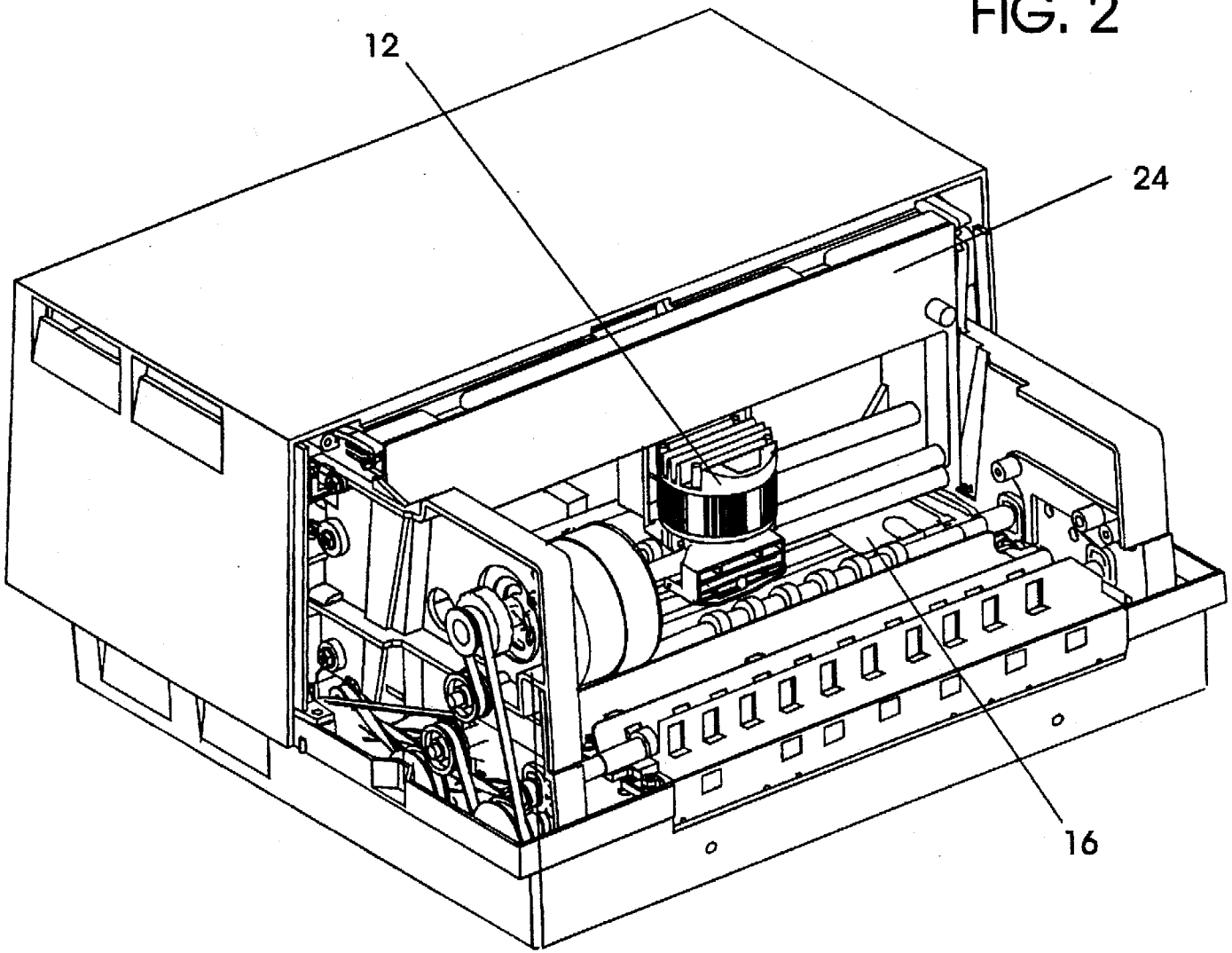
FIG. 2 is a perspective view of the printer of FIG. 1, with the front cover removed, illustrating a printhead, platen, and ribbon cartridge.
Figure 6:
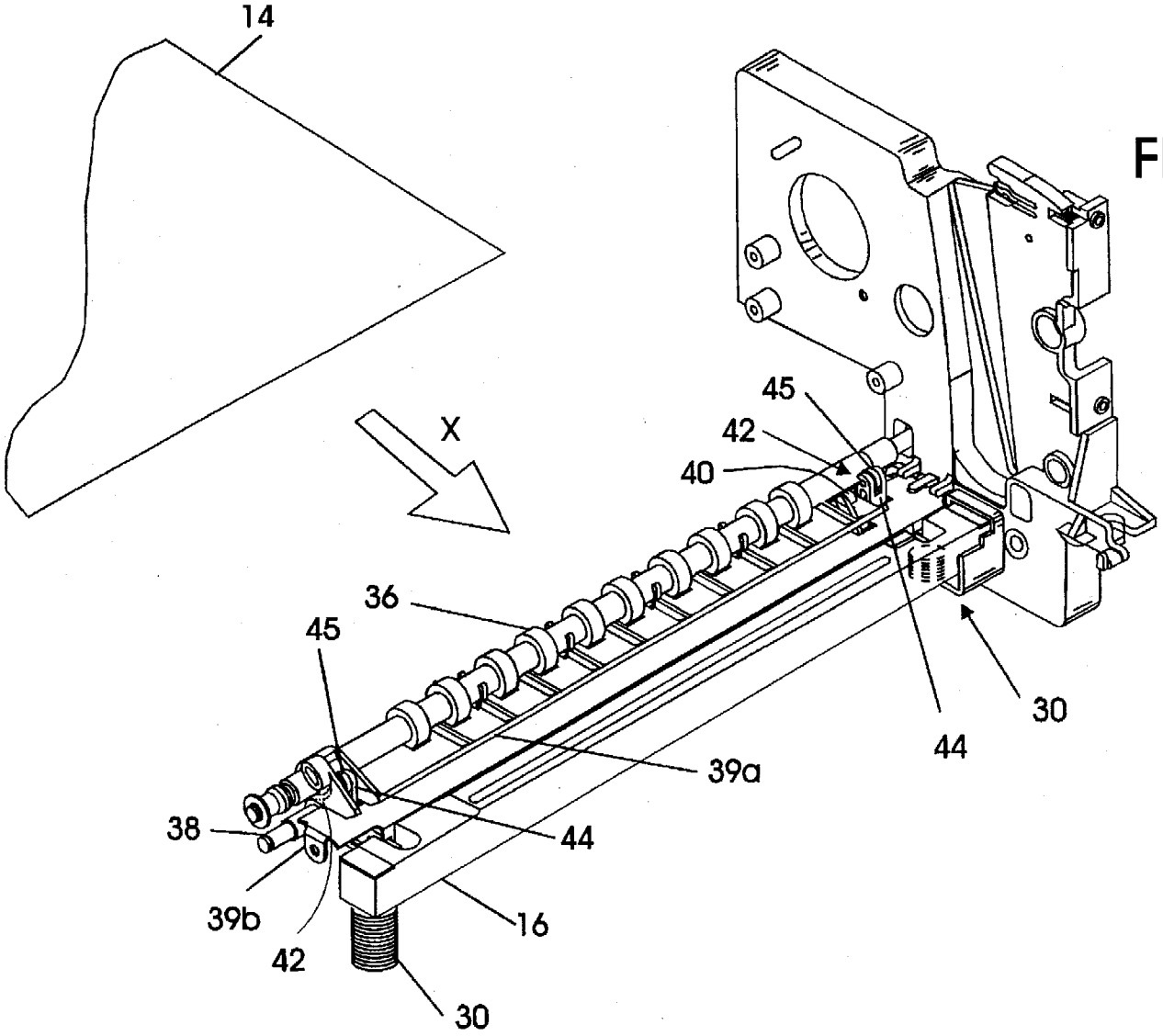
FIG. 6 is an isometric view of the feed roller assembly.

Referring now to FIG. 1, there is shown a printer 10 which might employ the invented apparatus and method. In FIG. 2, the front cover of the printer 10 depicted in FIG. 1 has been removed to illustrate a printhead 12 displaceable along a document or record carrier 14 advancing in the direction indicated by the arrow X. (Record carrier 14 and arrow X are shown in FIG. 6). The record carrier 14 is supported beneath the printhead 12 by a platen 16.

Figure 3:
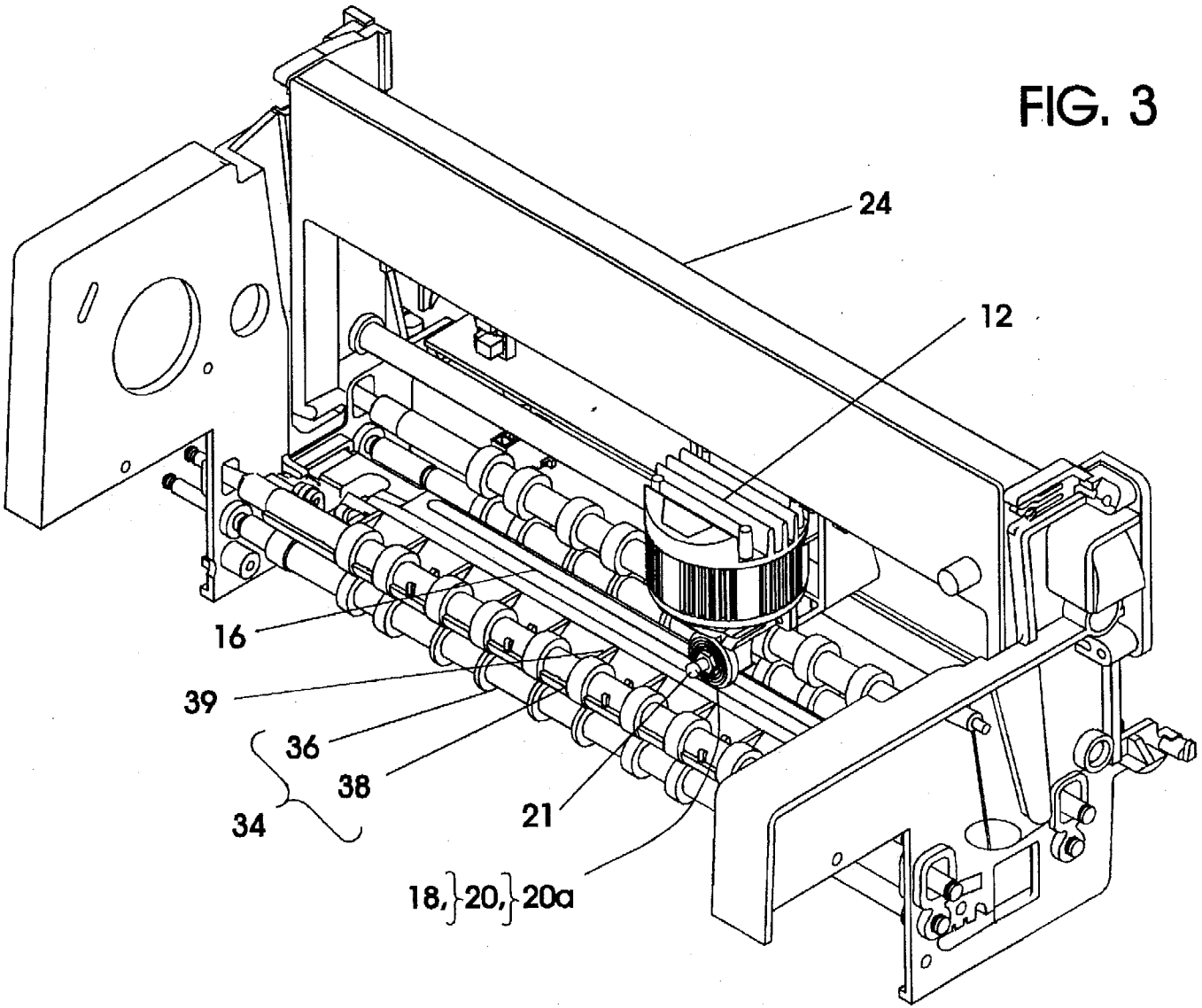
FIG. 3 is an isometric view depicting elements of the invented apparatus, with the ribbon shield removed.
Figure 4:
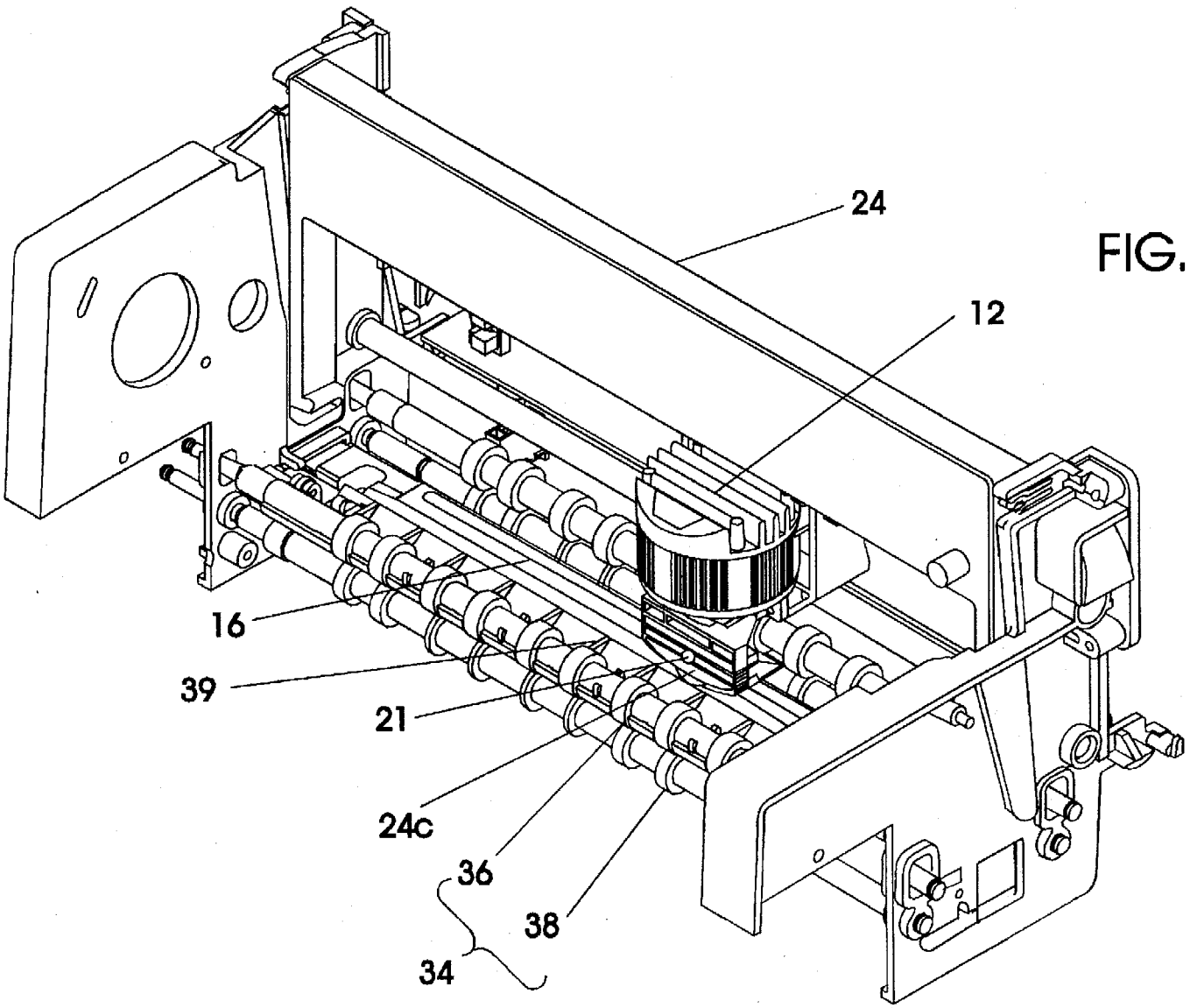
FIG. 4 is an isometric view depicting elements of the invented apparatus, with the ribbon shield included.
Figure 5:
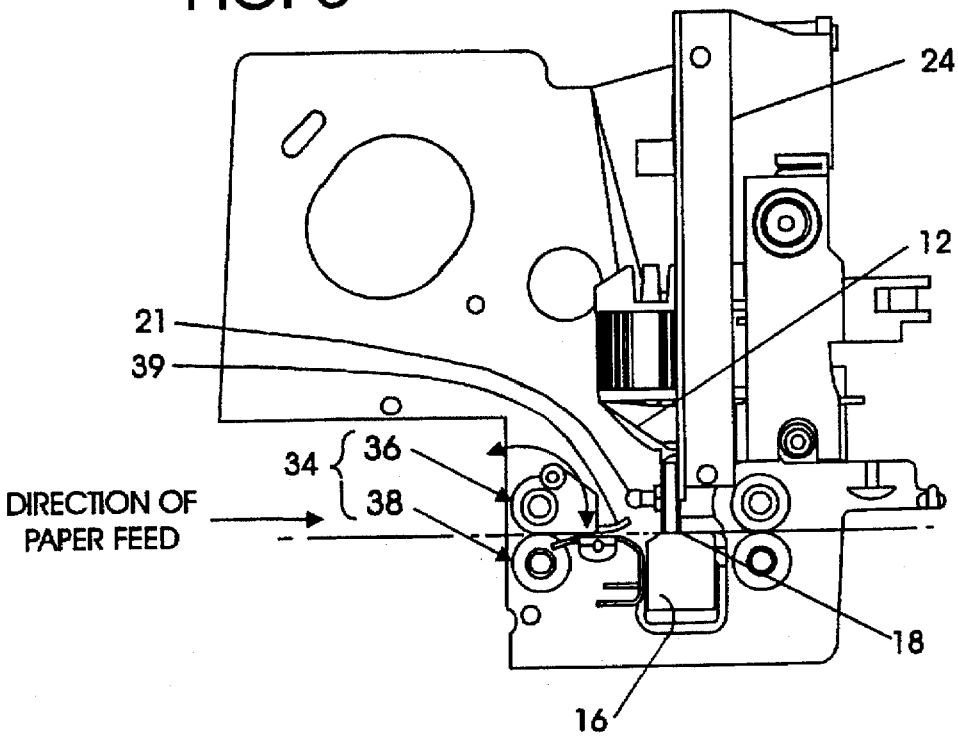
FIG. 5 is a right end view of FIG. 3 with the side plate removed.

Means 18 for spacing the printing distance between the printhead 12 and the record carrier 14, as shown in FIGS. 3, 4 and 5, is provided, positioned to bear upon the record carrier 14 in advance of the printhead 12, relative to the direction of an advancing record carrier 14. Spacing means 18 may advantageously be chosen to be a roller 20 rotatably mounted on axle 21 to the printhead 12. The periphery 20*a* of the roller 20 which bears upon the record carrier 14 is preferably a resilient material, such as rubber or an elastomer.

Figure 8:
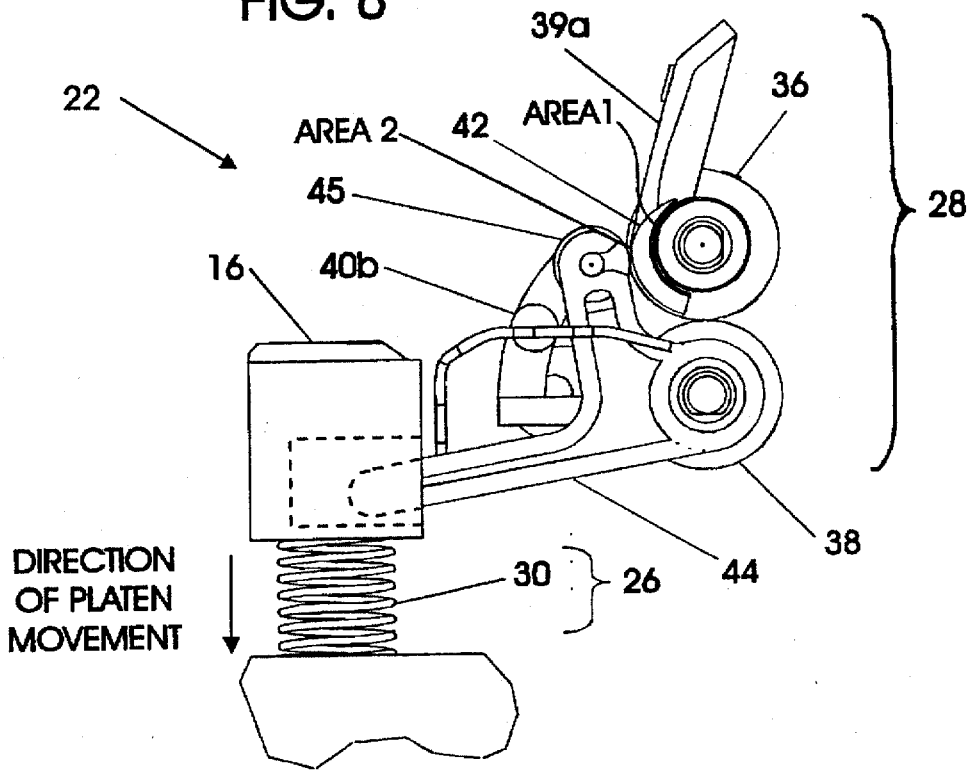
FIG. 8 is a side elevational view of FIG. 7, partially cut away along line W—W in FIG. 7, with the paper guide rotated upward.

As shown in FIG. 8, means 22 for urging the platen 16 away from the printhead 12 and the spacing means 18 so as to permit ribbon means 24 to be inserted between the printhead 12 and the platen 16 is also included. Platen urging means 22 includes both (i) means 26 for biasing the platen 16; and (ii) means 28, operably connected to the platen 16, for levering the platen 16 to and from said printhead 12. Biasing means 26 includes at least one spring 30 which connects the platen 16 to the printing device 10.

Figure 7:
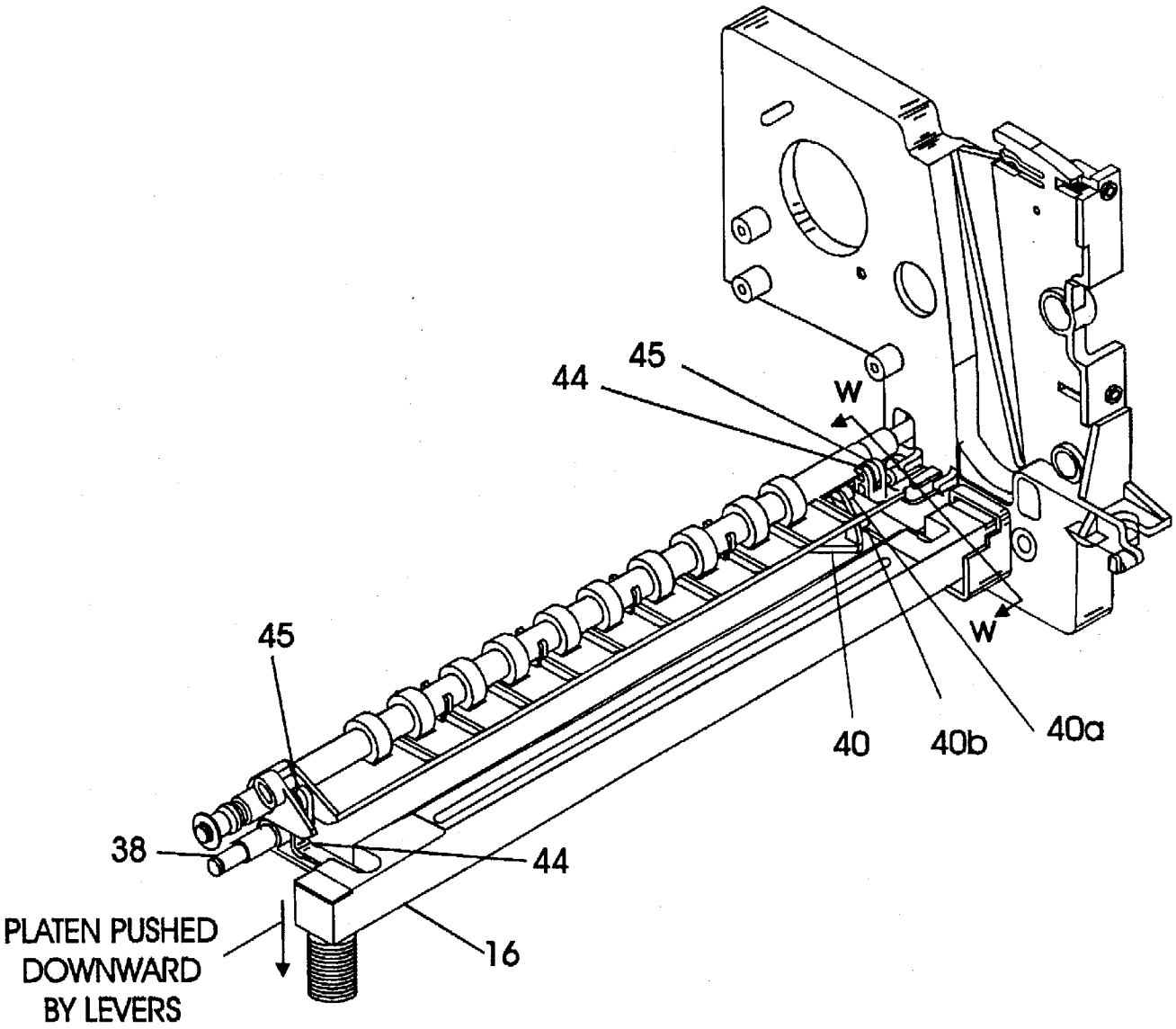
FIG. 7 is an isometric view of FIG. 6 with the lower paper guide removed.
Figure 9:
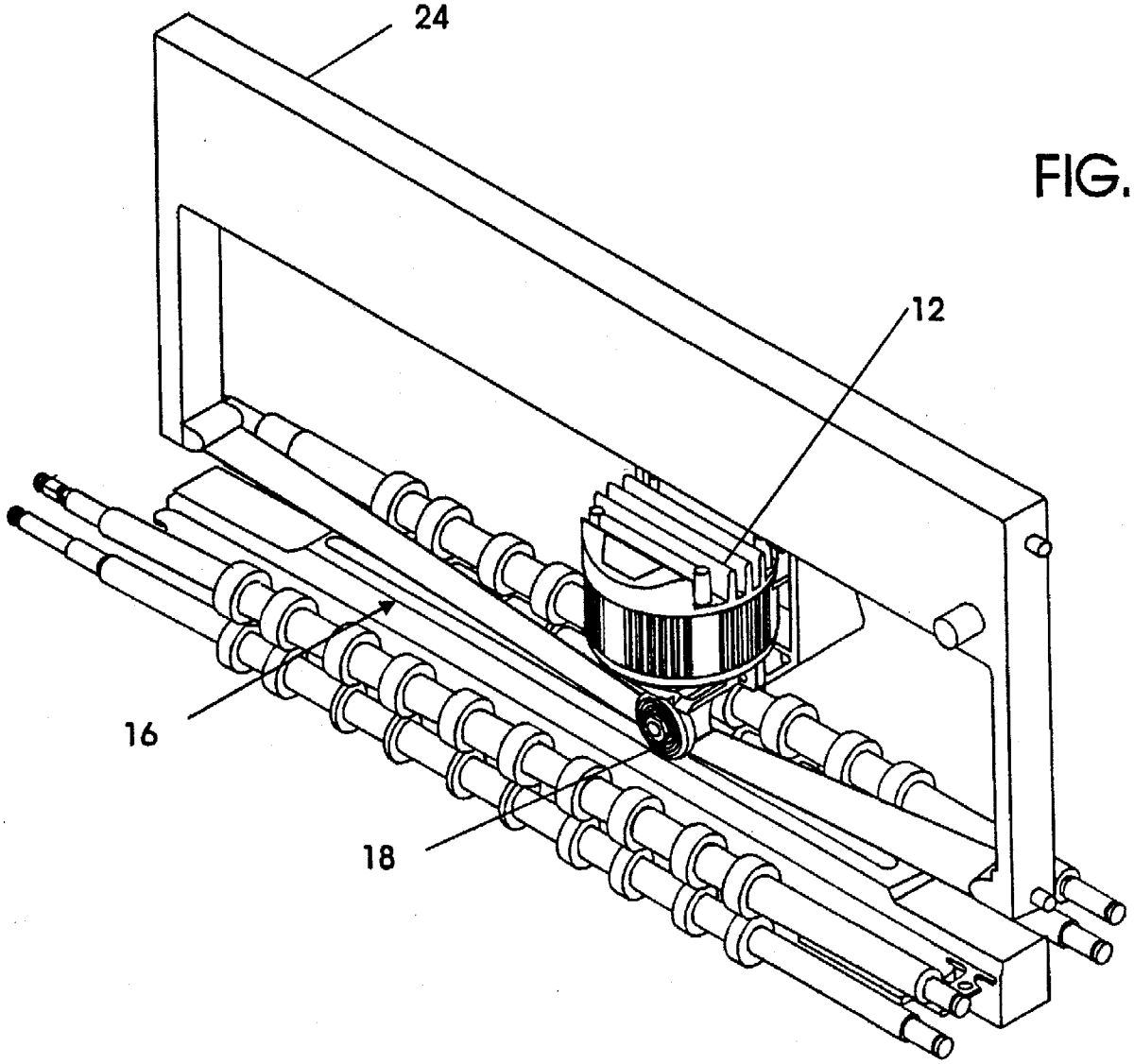
FIG. 9 is an isometric view depicting elements of the invented apparatus, with the ribbon shown beneath the printhead.
Figure 11:
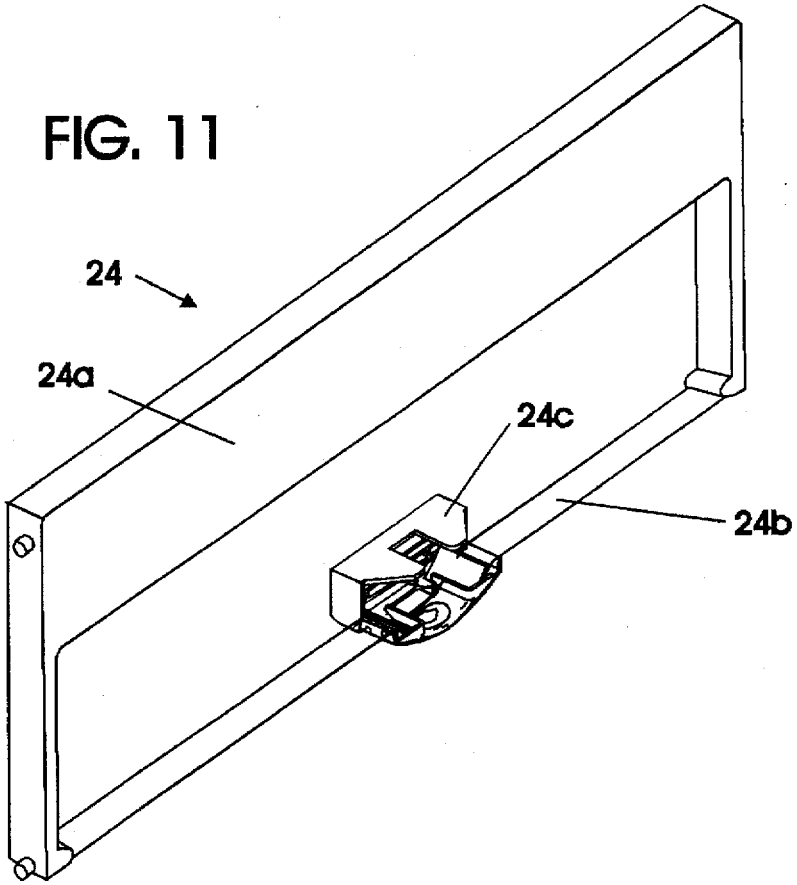
FIG. 11 is an isometric view of a ribbon cartridge which includes the invented ribbon shield.
Figure 12:
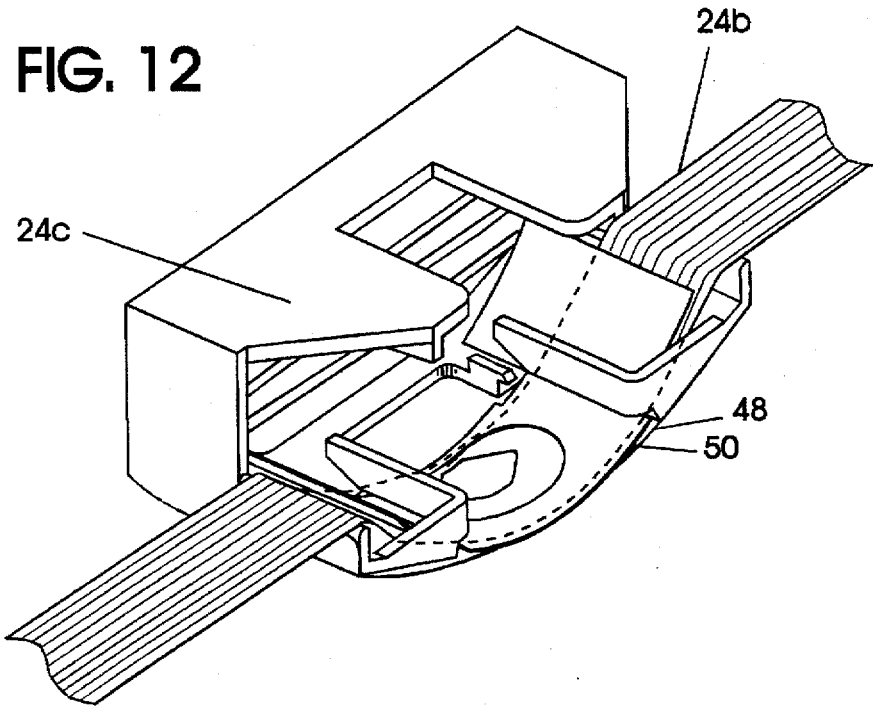
FIG. 12 is an enlarged view of the invented ribbon shield depicted in FIG. 11.

Printing device 10 also includes means 34 for feeding the record carrier 14 between the spacing means 18 and the platen 16. First and second rollers 36, 38, shown in FIGS. 6 and 7, are pivotally mounted so as to yieldingly engage and hold both sides of the record carrier 14. The first roller 36 is positioned above the second roller 38. Means 39 for guiding the record carrier 14 between the spacing means 18 and the platen 16 and under the printhead 12 may be advantageously provided. A first guide **39*a* is rotatably mounted to the first roller 36. A second guide 39*b* may be suspended beneath the first guide 39*a***.

First and second guides **39*a*, 39*b* act to direct the record carrier 14 into the first and second rollers 36, 38 during document ejection. A clutch 40 is attached to the second roller 38 such that when the record carrier 14 is being fed into the printer 10 the upper tab 40*a* on the clutch 40 pulls down the first guide 39*a*. The first guide 39*a* in turn holds the record carrier 14 flat as it passes between the first guide 39*a* and the second guide 39*b*. During printing, the trailing edge of the record carrier 14 will exit feeding means 34. To guide the edge of the record carrier 14 back into the feeding means 34 as the record carrier 14 is ejected, the feeding means 34 reverses direction which causes the clutch 40 to rotate with the second roller 38. As the clutch 40 rotates, the lower tab 40*b* on the clutch 40 pushes up on the first guide 39*a*** and rotates it up approximately 30 degrees.

Feeding means 34 also pushes the platen 16 down when the first guide **39*a* is rotated more that approximately 30 degrees. The first guide 39*a* can only be rotated past 30 degrees if the operator manually rotates it (e.g., during a ribbon cartridge replacement). When the first guide 39*a* is rotated more than approximately 30 degrees, integral cams 42 engage the levers 44 and lever rollers 45, which rotate about the shaft of the second roller 38 and in turn push the platen 16 down. The platen 16 and first guide 39*a* will return to their original positions automatically when the feed rolls 36, 38 begin to turn in the reverse or ejection direction. The friction force created between the first guide 39*a* and the first roller 36 is greater than the friction force created between the lever roller 45 and the first guide 39*a* so as to allow the first guide 39*a* to turn with the first roller 36 until the cam surface is rotated back to its orginal position and the lever 44 is unloaded by the platen 16**.

Ribbon means 24 preferably includes a ribbon cartridge **24*a*, a ribbon 24*b*, and a ribbon shield 24*c*. The ribbon cartridge 24*a* is of a type well known in the art and is comprised of a main housing which contains a supply of ribbon 24*b* therein and two arms which depend from the main housing. Ribbon 24*b* within the main housing is thread out of the end of one arm and into the end of the other arm to form a ribbon loop. The ribbon 24*b* is also thread through the ribbon shield 24*c*. The ribbon shield 24*c* is suspended on the ribbon 24*b*** between the two arms beneath the main housing.

Ribbon shield **24*c* includes means 46 for releasably attaching the shield over the roller 20 and onto the printhead 12. Outer shield 48, integral with attaching means, is adapted for receiving ribbon 24*b* thereon. Outer shield 48 has an aperture for permitting the printhead to print upon the record carrier. Inner shield 50 is positioned above outer shield 48 for receiving ribbon 24*b* thereunder. Inner shield 50 also has an aperture, corresponding to the outer shield aperture. Inner and outer shields 48, 50 slidably engage ribbon 24*b*** therebetween.

The nose or face of the printhead 12 is chamfered so as to make it narrower that the ribbon **24*b*. The ribbon 24*b* must pass under and past the first roller 36 for installation of the ribbon 24*b* and cartridge 24*a*. The complete width of the ribbon 24*b* must bend over the chamfers on the nose of the printhead 12 when tension is applied to the ribbon 24*b*. Outer and inner shields 48, 50 hold the ribbon 24*b* in place and are bowed out to hold the ribbon 24*b* beyond the first roller 36 during installation. When the shield 24*c* is in place the inner shield 50 supports the ribbon 24*b* as it is pulled tighly around the printhead 12. Once raised, the platen 16 makes contact with the first roller 36. The outer and inner shields 48, 50 deflect slightly when the platen 16 is raised and the ribbon 24*b* is supported instead of wrapping over the chamfers on the printhead nose. Thus, the shield 24*c* supports the entire width of the ribbon 24*b* as it passes under the nose of the printhead 12**. Wear and tear is minimized.

Figure 13:
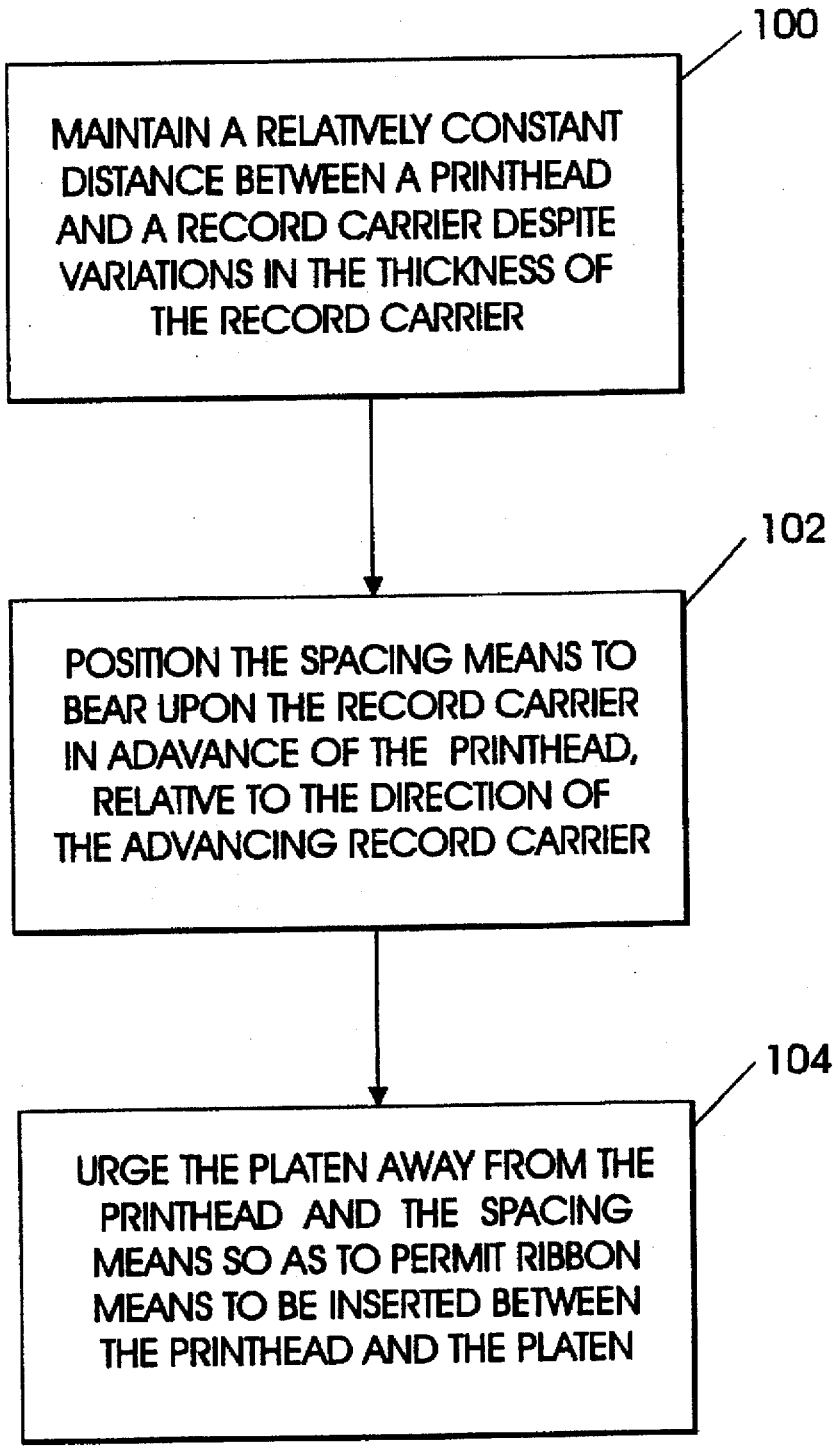
FIG. 13 is a flow diagram of an embodiment of invented method of installing a ribbon beneath a printhead.

As depicted in FIG. 13, in a printing device having a printhead displaceable along a record carrier, the record carrier being supported beneath the printhead by a platen, a method of installing a ribbon beneath a printhead comprises the following steps. In step 100, the printing distance between the printhead and the record carrier is adjusted with spacing means. The spacing means is positioned to bear upon the record carrier in advance of the printhead, in step 102. In step 104, the platen is urged away from the printhead and the spacing means so as to permit ribbon means to be inserted between the printhead and the platen.

Of course, many modifications and adaptations to the present invention could be made to advantage without departing from the spirit of this invention. Further some features of the present invention could be used without corresponding use of other features. Accordingly, this description should be considered as merely illustrative of the principles of the present invention and not in limitation thereof.

We claim:

1. In a printing apparatus having a printhead displaceable along a record carrier, said record carrier being supported beneath said printhead by a platen, the improvement comprising:

(a) means, carried by said printhead, for spacing the printing distance between said printhead and said record carrier, said spacing means positioned to bear upon said record carrier in advance of said printhead;

(b) means for selectively urging said platen away from said printhead and said spacing means so as to permit ribbon means to be inserted between said printhead and said platen; and (c) a shield for a ribbon inserted beneath said printhead and above said record carrier, wherein said shield includes (i) means for releasably attaching said shield over said spacing means and onto said printhead;

(ii) an outer shield, integral with said attaching means, for receiving said ribbon thereon, having an aperture for permitting said printhead to print upon said record carrier; and (iii) an inner shield positioned above said outer shield, for receiving said ribbon thereunder, having an aperture corresponding to said outer shield aperture, wherein said inner and outer shields are capable of slidably engaging said ribbon therebetween.

* * * * *